US009587581B2

(12) United States Patent
Hashim

(10) Patent No.: US 9,587,581 B2
(45) Date of Patent: Mar. 7, 2017

(54) WIDEBAND DIESEL FUEL RAIL CONTROL USING ACTIVE PRESSURE CONTROL VALVE

(71) Applicant: GM Global Technology Operations LLC, Detroit, MI (US)

(72) Inventor: Tariq O. Hashim, Bloomfield Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 246 days.

(21) Appl. No.: 13/922,613

(22) Filed: Jun. 20, 2013

(65) Prior Publication Data

US 2014/0373812 A1 Dec. 25, 2014

(51) Int. Cl.

| | |
|---|---|
| ***F02D 41/38*** | (2006.01) |
| *F02D 41/14* | (2006.01) |
| *F02D 41/20* | (2006.01) |

(52) U.S. Cl.

CPC .. *F02D 41/3863* (2013.01); *F02D 2041/1409* (2013.01); *F02D 2041/2027* (2013.01); *F02D 2250/04* (2013.01)

(58) Field of Classification Search

CPC ..... F02D 2200/0602; F02D 2250/31; F02D 19/0684; F02D 41/3836; F02D 41/3809; F02M 63/0225

USPC ..... 123/444–457; 701/101–104

See application file for complete search history.

(56) References Cited

U.S. PATENT DOCUMENTS

| | | | | |
|---|---|---|---|---|
| 6,705,278 | B2 * | 3/2004 | McGee | F02D 41/045 123/299 |
| 6,755,176 | B2 * | 6/2004 | Takeuchi | F02D 41/0085 123/299 |
| 7,121,263 | B2 * | 10/2006 | Eser | F02D 41/3845 123/446 |
| 7,198,034 | B2 * | 4/2007 | Ausiello | F02M 59/265 123/506 |
| 7,302,935 | B2 * | 12/2007 | Achleitner | F02D 41/3845 123/446 |
| 7,938,101 | B2 * | 5/2011 | Cinpinski | F02D 41/2467 123/446 |
| 8,118,014 | B2 * | 2/2012 | Lippa | F02D 19/0684 123/431 |
| 8,281,768 | B2 | 10/2012 | Cinpinski et al. | |
| 8,306,723 | B2 | 11/2012 | Haskara et al. | |
| 2005/0279867 | A1 * | 12/2005 | Ismailov | F02D 41/20 239/585.1 |
| 2008/0269984 | A1 * | 10/2008 | Achleitner | F02D 41/3017 701/36 |

(Continued)

OTHER PUBLICATIONS

Chinese Office Action dated Mar. 3, 2016.

(Continued)

*Primary Examiner* — Long T Tran

(74) *Attorney, Agent, or Firm* — Harness, Dickey & Pierce, P.L.C.

(57) ABSTRACT

A method and system for actively controlling the fuel pressure in the fuel rails of a fuel injection system is disclosed for providing wideband fuel rail control. An active pressure control circuit controls the pressure control valve over the entire range of engine operating conditions and in the frequency domain. Implementation of a closed-loop feedback control is effective for attenuating fuel pressure fluctuations in the fuel rail assembly.

8 Claims, 4 Drawing Sheets

(56) References Cited

U.S. PATENT DOCUMENTS

| | | | | |
|---|---|---|---|---|
| 2008/0302174 | A1* | 12/2008 | Puckett | F02D 41/221 73/114.41 |
| 2009/0235901 | A1* | 9/2009 | Akita | F02M 55/04 123/506 |
| 2009/0250038 | A1* | 10/2009 | Xu | F02D 41/22 123/457 |
| 2010/0282214 | A1 | 11/2010 | Albrecht et al. | |
| 2011/0023830 | A1* | 2/2011 | Haas | F02D 33/006 123/446 |
| 2011/0030655 | A1* | 2/2011 | Kaneko | F02D 41/22 123/456 |
| 2011/0077842 | A1* | 3/2011 | Hofmeister | F02D 41/1497 701/104 |
| 2011/0146619 | A1* | 6/2011 | McAlister | F02M 51/0675 123/297 |
| 2011/0180039 | A1* | 7/2011 | Nada | F02D 35/02 123/445 |
| 2012/0203422 | A1 | 8/2012 | Suda et al. | |
| 2013/0000604 | A1 | 1/2013 | Gerstner et al. | |
| 2013/0080032 | A1 | 3/2013 | Kaneko et al. | |

OTHER PUBLICATIONS

"Experimental study of common rail pressure control based on spilling valve"; Liu Zhang et al; Journal of Naval University of Engineering; China Academic Journal Electronic Publishing House; vol. 22, No. 4 (Aug. 2010).

* cited by examiner

WIDEBAND DIESEL FUEL RAIL CONTROL USING ACTIVE PRESSURE CONTROL VALVE

FIELD

The present disclosure relates to a fuel injection system for an internal combustion engine; and more particularly to a method and apparatus for minimizing hydrodynamic problems associated with wave phenomena in the fuel rail.

BACKGROUND

This section provides background information related to the present disclosure which is not necessarily prior art.

Fuel injections systems configured to supply high-pressure fuel from a fuel pump to a set of fuel injectors are well-known. In such systems, a fuel rail assembly consists of common rail and the injector feed lines supplying the fuel from the pump to the injectors and functions as a high-pressure accumulator to stabilize the fuel pressure. The dynamics of this system are such that pressure fluctuations in the fuel rail assembly during all phases of operation may excite certain hydrodynamic and structural resonances. These resonant frequencies depend on the geometry of the fuel rail assembly and the bulk moduli of the rail material and the fuel, which in turn depend on the temperature of these components.

The pressure fluctuations result from a plurality of hydrodynamic inputs in the system including pressure pulses generated by the high-pressure pump, pressure pulses induced by opening and closing of the injectors, and pressure pulses resulting from fluid waves present in the fuel rail and injector lines. The frequency of these pressure pulses vary over the operating range of the engine, and thus can drive multiple resonances of the fuel rail assembly depending on the load and operating conditions of the engine. The hydro-mechanical interaction between the pressure waves and the fuel rail assembly when driven at resonant frequencies can generate unwanted noise and vibration which propagates from the vehicle engine. In addition, extreme excitation of the fuel rail assembly may accelerate structural fatigue in the components of the assembly, thereby affecting the durability of the fuel injection system.

Accordingly, there is a need to develop a means for controlling fuel pressure to provide a stable fuel pressure and attenuate dynamic pressure waves within the system over the entire range of operation.

SUMMARY

This section provides a general summary of the disclosure, and is not a comprehensive disclosure of its full scope or all of its features.

A wideband fuel rail pressure control is disclosed which uses a pressure control valve with an active feedback loop to minimize pressure fluctuations and stabilize fuel pressure in the fuel rail assembly during all phases of operation. The active pressure control valve is used to address frequency-domain phenomena over the engine operation envelope.

In particular, a fuel injection system for a multi-cylinder internal combustion engine is disclosed. The fuel injection system includes a fuel injector pump supplying fuel to a fuel rail assembly and a plurality of fuel injectors fluidly coupled to the fuel rail assembly. Each of the plurality of fuel injectors injects the fuel into an associated combustion chamber. A pressure sensor fluidly coupled to the fuel rail assembly generates a fuel pressure signal indicating a measured fuel pressure in the fuel rail assembly. A fuel pressure control valve is fluidly coupled to the fuel rail assembly and adjusts the fuel pressure in the fuel rail assembly in response to a valve control signal. A fuel pressure control module receives the fuel pressure signal and a reference or target fuel pressure. An active pressure control circuit in the fuel pressure control module generates the valve control signal as a function of the difference between the fuel pressure signal and the reference fuel pressure. The fuel pressure control module repeatedly generates the valve control signal to provide active control of the fuel pressure control valve over the entire operating range of the engine, thereby reducing pressure fluctuation of the fuel pressure in the fuel rail system.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a schematic illustration of a fuel injection system for an internal combustion engine;

FIG. 2 schematically illustrates a preferred feedback control circuit for controlling the pressure control valve;

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope of this disclosure to those who are skilled in the art. Specific details may be set forth to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known structures, and well-known technologies are not described in detail.

The terminology used herein is for the purpose of describing particular example embodiments only and is not intended to be limiting. As used herein, the singular forms "a," "an," and "the" may include the plural forms as well, unless the context clearly indicates otherwise. The terms "comprises," "comprising," "including," and "having," are inclusive and therefore specify the presence of recited structure(s) or step(s); for example, the stated features, integers, steps, operations, groups elements, and/or components, but do not preclude the presence or addition of additional structure(s) or step(s) thereof. The methods, steps, processes, and operations described herein are not to be construed as necessarily requiring performance in the stated or any particular order discussed or illustrated, unless specifically identified as an order of performance. It is also to be understood that additional, alternative or equivalent steps may be employed.

Figure 1:
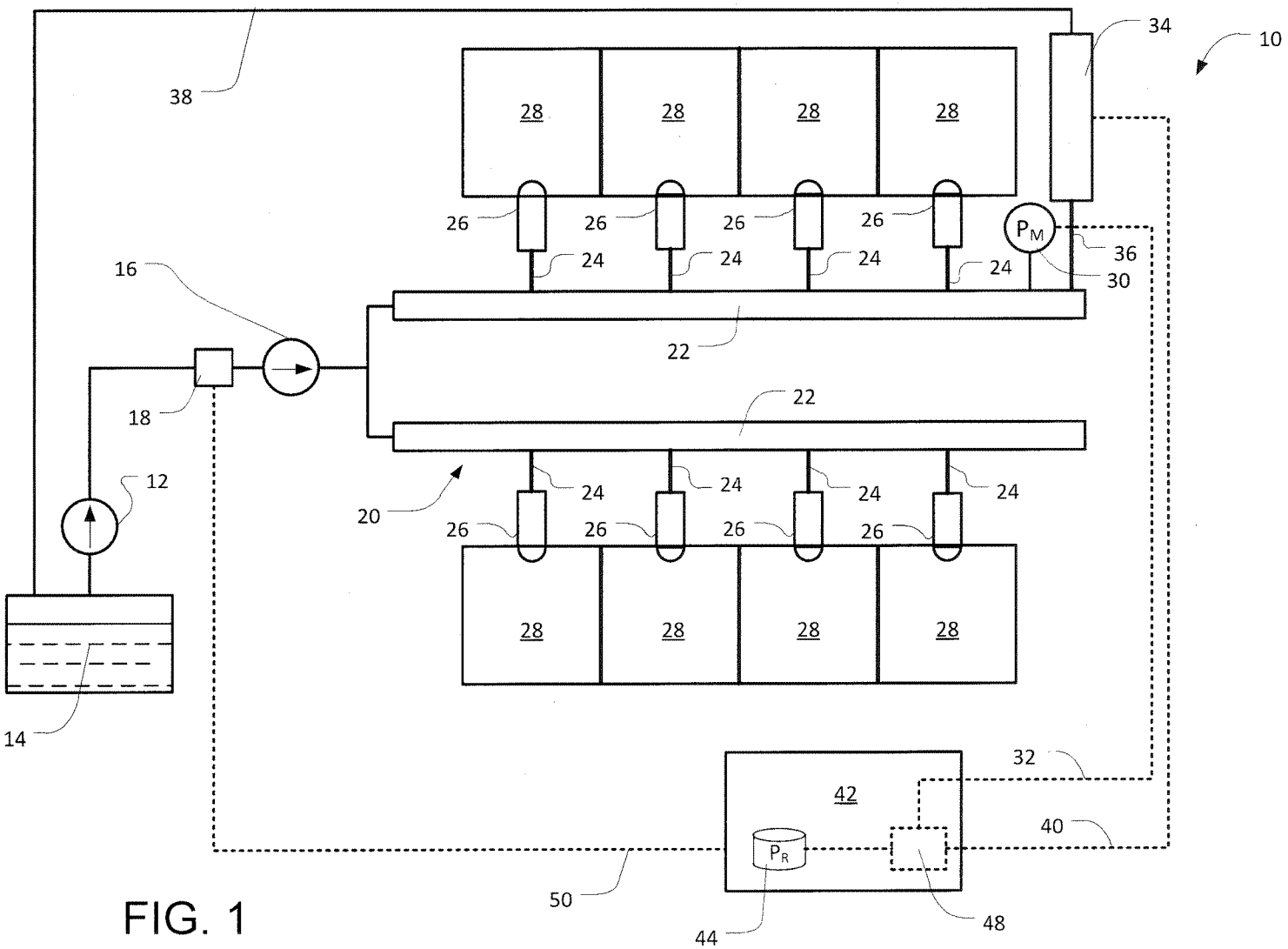

With reference now to FIG. 1, a fuel injection system 10 is illustrated. The fuel injection system 10 includes a low-pressure feed pump 12 fluidly coupled to a fuel tank 14 which pumps fuel to a high-pressure injector pump 16. A metering unit 18 regulates the flow of fuel to the injector pump 16. A fuel rail assembly 20 which includes fuel rails 22 is fluidly coupled to the injector pump 16. Injector lines 24 extend from the fuel rails 22 and fluidly couple with the fuel injectors 26 for directly injecting fuel into an associated combustion chamber 28 of an internal combustion engine. A pressure sensor 30 is fluidly coupled to the fuel rail 22 to measure the actual operating fuel pressure therein and generate a fuel pressure signal 32 representative of the fuel pressure in the fuel rails. A pressure control valve 34 is fluidly coupled to the fuel rail 22 by feed line 36 and fluidly coupled to the fuel tank 14 by drain 38. As presently preferred, the pressure control valve 34 is a solenoid-controlled valve operable in response to a control signal 40 to adjust the flow of fuel through the valve 34 and thereby control the fuel pressure in the fuel rail assembly 20.

An engine control module 42 has a data store 44 which stores a target pressure ($P_R$) and receives the fuel pressure signal 32 from the pressure sensor 30. The engine control module 42 has an active pressure valve control circuit 48 for generating the valve control signal 40. The engine control module 42 may also issue a control signal 50 for controlling the metering unit 18 and the fuel to injector pump 16. While the function and operation of engine control module 42 described herein is limited to pressure control for the fuel injection system 10, one skilled in the art will recognize that the engine control module 42 may perform many additional functions and operations associated with the internal combustion engine in general and the fuel injection system in particular.

Figure 2:
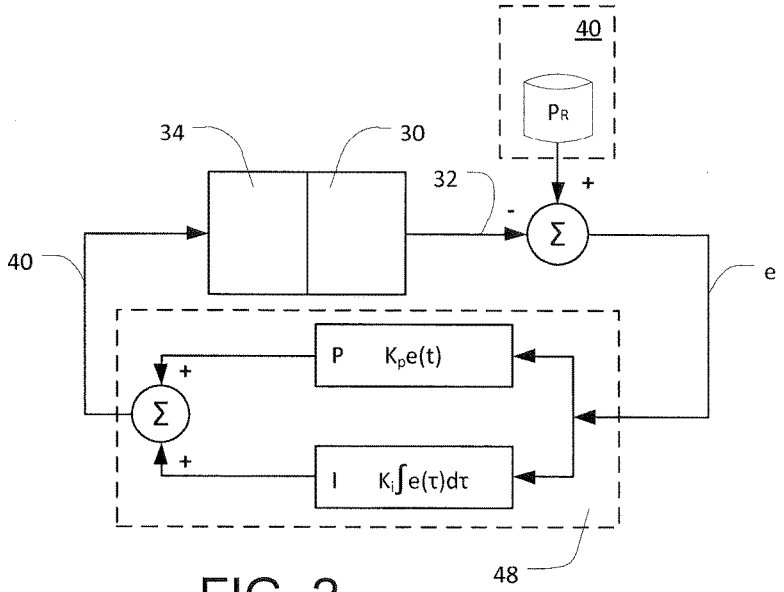

With reference now to FIGS. 1 and 2, active control of the pressure control valve 34 is further described. As presently preferred, the pump control circuit 48 includes a proportional-integral controller or PI controller which provides feedback control of the pressure control valve 34 based on a calculated "error" value between the measured pressure $P_M$ from the pressure sensor 30 and the reference or target pressure $P_R$ from the engine control module 42. In this control algorithm, the measured fuel pressure $P_M$ is the process value, the reference pressure $P_R$ is the set point, and the pressure control valve position $V_P$ is the manipulated variable. The difference between the measured fuel pressure and the reference pressure is the error e which quantifies whether the fuel pressure in the fuel rail assembly is too high or too low and by how much. After measuring the fuel pressure and calculating the error, the controller computes a control signal 40 to adjust the pressure control valve position as a function of the current error valve $K_p e(t)$ and the sum of the instantaneous error over time $K_i \int e(\tau)d\tau$. The control signal 40 provides a frequency and magnitude for adjustment of the pressure control valve 34. If the measured fuel pressure is greater than the reference pressure, the control signal 40 will command the pressure control valve to open. Conversely, if the measured fuel pressure is less than the reference pressure, the control signal will command the pressure control valve to close While the above-described control has proved effective for reducing over-pressurizing fuel in the fuel rail assembly 20 and resonance of the fuel rail assembly 20, additional benefits may be gained by implementing a rail pressure control strategy that relates operation of the metering unit 18 and/or the pressure control valve 34 with system characteristic frequencies for minimizing resonance of components in the fuel injection system 10. For example, the pulse width cycle of pressure control valve 34 may be varied as a function of a particular resonant frequency of the system. Adjusting the pressure control valve 34 in this manner provides intelligent recirculation of fuel to the fuel tank for effectively controlling the pressure amplitudes in the fuel rail assembly 20. The algorithm may include a similar control of the metering valve 18 as a function of a particular resonant frequency of the system. Controlling the metering valve 18 in this manner provides intelligent supply of fuel to the fuel rail assembly 20 for effectively controlling the pressure amplitudes therein.

Figure 3:
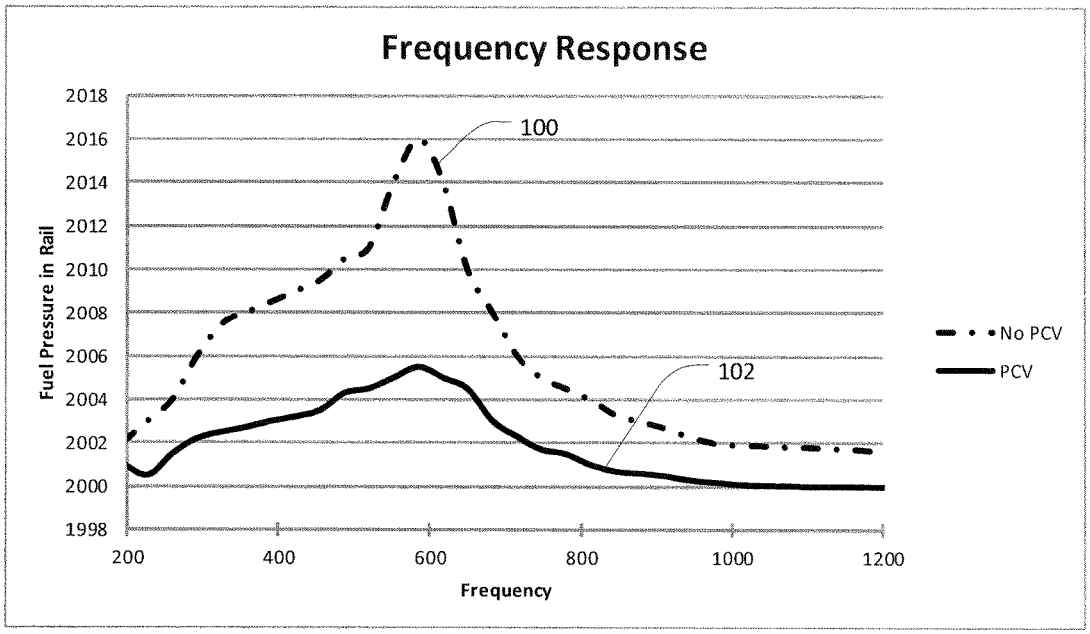
FIG. 3 shows a graph comparing the frequency response of the fuel rail assembly with and without the active pressure control valve.

FIG. 3 shows the frequency response for a computer-based model for the fuel rail assembly 20 without injectors 26 to compare the effect of wideband fuel rail pressure control using the active pressure control valve 32. A vibratory stimulus defined by a sinusoidal pressure wave of rising frequency (i.e. ±10 Bar from 0-25 kHz) was used as an input from the position of the high-pressure injector pump 16 into the fuel rail assembly 20. Curve 100 shows the measured pressure at the pressure sensor 30 of the fuel injection system without active pressure control. This data shows that the fuel rail assembly 20 has a resonance at about 600 Hz which results in an amplified pressure wave (i.e. greater than the input pressure wave) over the frequency range of about 470-650 Hz. Curve 102 shows the measured pressure at the pressure sensor 30 of the fuel injection system 10 with active pressure valve control with the same input. While the resonant peak at about 600 Hz is still apparent, the active pressure control valve 34 has effectively reduced its amplifying effect in the system, and thus attenuates the wave action within the fuel rail assembly 20.

Figure 4:
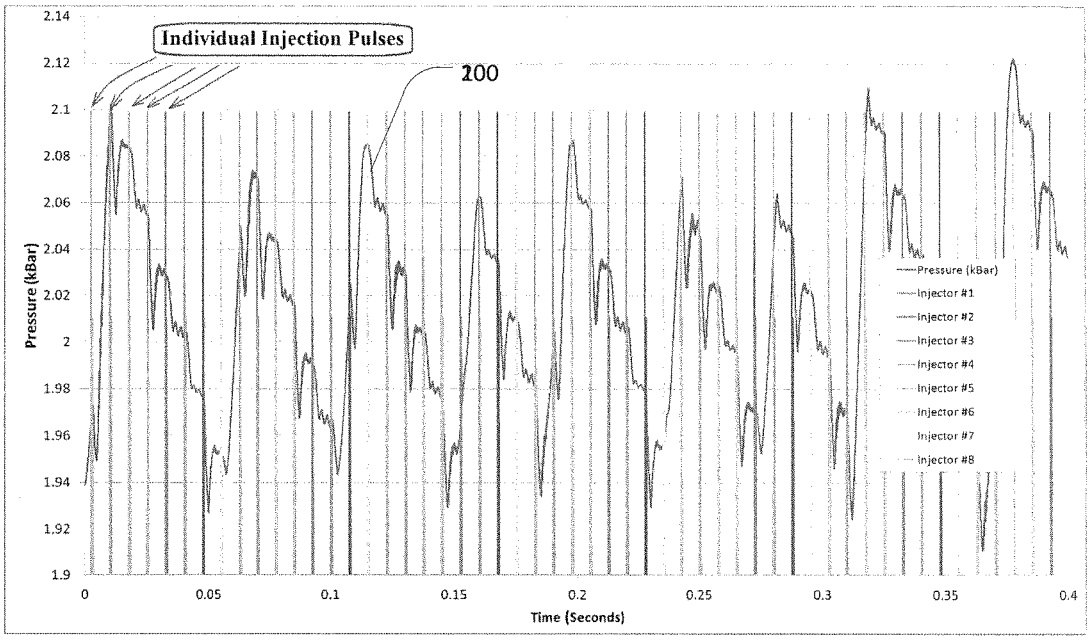
FIG. 4 shows a graph of the fuel pressure over a period of time for a conventional fuel injection system.

FIG. 4 shows time domain results of the computer-based model described above in reference to FIG. 3 without active pressure control. In particular, operation of the fuel injection system 10 was simulated at 2000 rpm and a fuel pressure of 2000 Bar in the fuel rail assembly 20 over a period of 0.4 seconds. The pulses associated with the fuel injectors 26 can be seen as a spike each time an injector fires with a firing order of 8-4-5-6-3-1-2-7. The pressure wave in the fuel rail system 20 is represented by curve 200 and periodically fluctuates in the range of 1930-2120 Bar. Thus, the fuel pressure in the fuel rail assembly without active pressure control fluctuates by about 10% and overshoots the set point pressure of 2000 Bar by about 6%.

Figure 5:
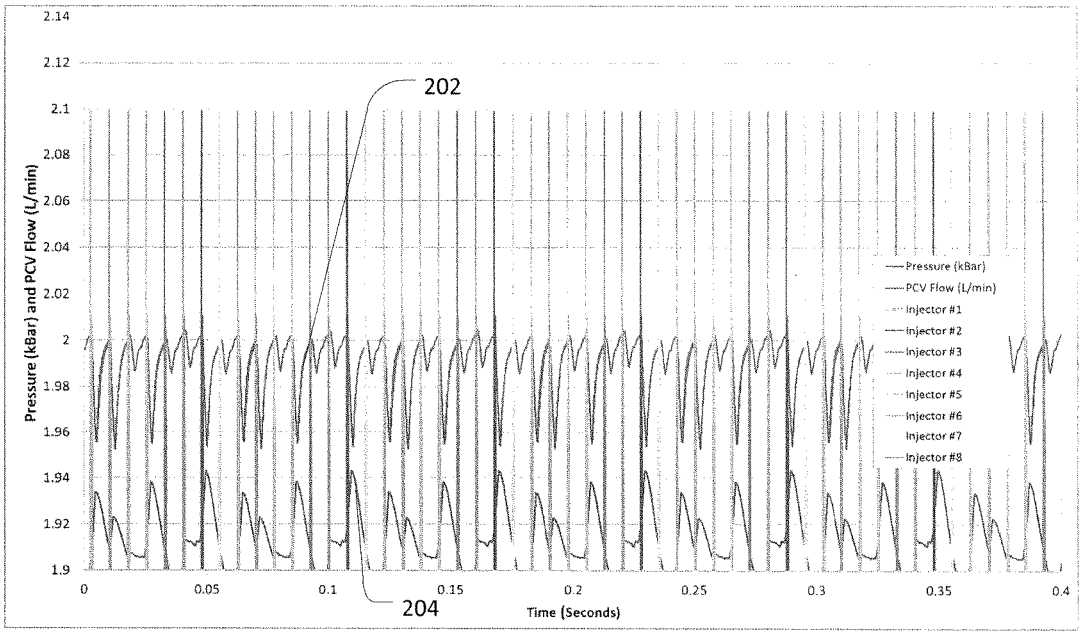
FIG. 5 shows a graph of the fuel pressure over a period of time for a fuel injection system with an active pressure control valve.

FIG. 5 shows time domain results of the same computer-based model with active pressure control. Again, the pulses associated with the fuel injectors 26 can be seen as a spike each time an injector fires with a firing order of 8-4-5-6-3-1-2-7. The pressure wave in the fuel rail system 20 is represented by curve 202. The pressure fluctuations are significantly less than that shown in FIG. 4, on the order of about 2% and the pressure does not exceed the set point pressure. FIG. 5 also shows fuel flow through the pressure control valve in terms of liters/min at curve 204. The time constant equal to zero seconds was used for the pressure control valve 34 modeled for FIG. 5.

Figure 6:
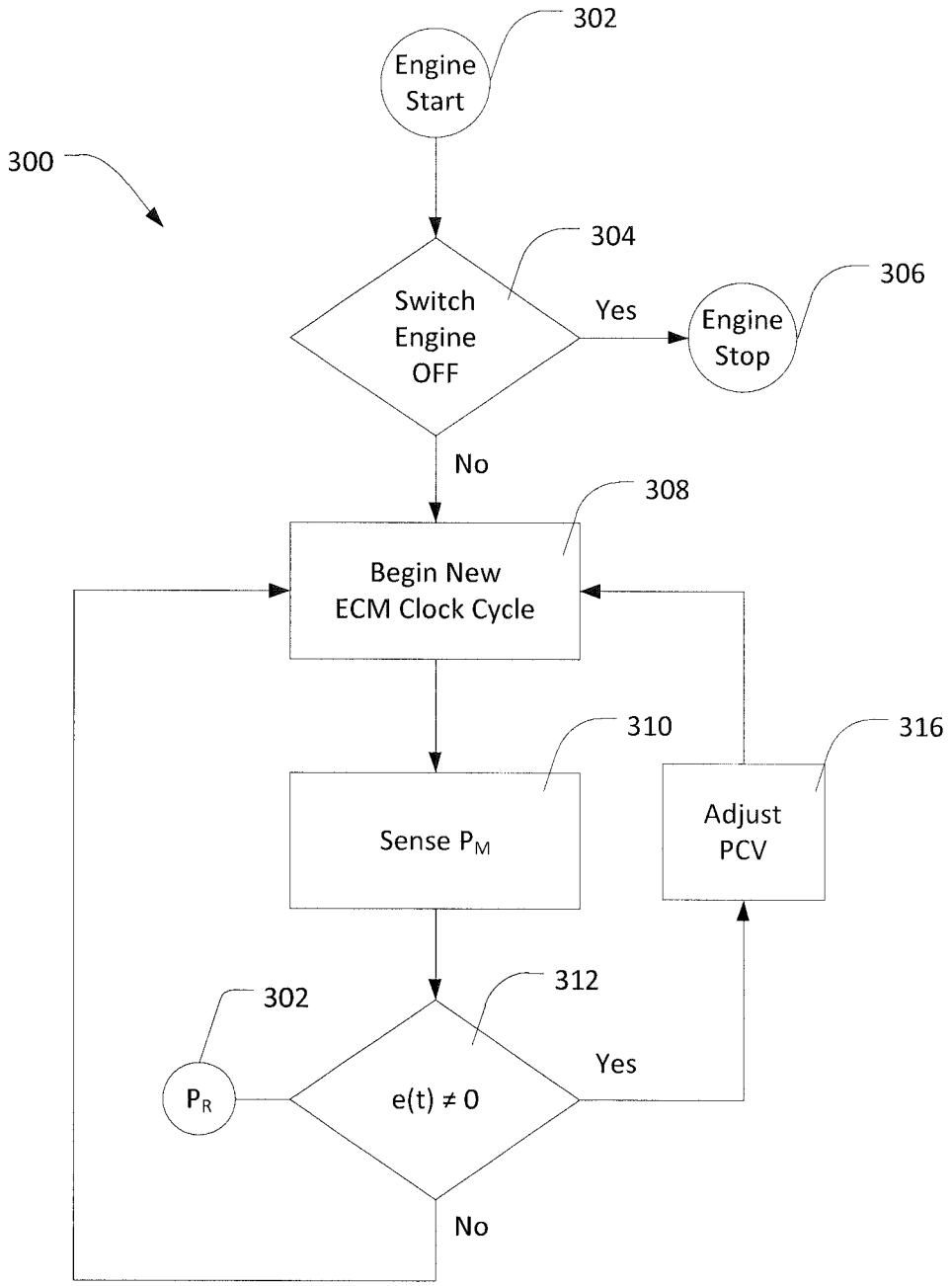
FIG. 6 is a flowchart showing the logic for the active pressure control valve algorithm.

With reference now to FIG. 6, a method for wideband fuel rail control using an active pressure control valve will now be described with reference to flowchart 300. Initially, a start engine command 302 is issued and the ECM queries the position of the engine switch as shown at block 304. If the switch is "OFF" the active pressure control stops as shown at block 306. If the switch is not "OFF", the active pressure control is initiated in accordance with the ECM clock cycle as shown at block 308. Next, the pressure sensor 30 is read and the measured pressure signal 40 and the reference pressure value 44 are sent to the ECM as shown at blocks 310, 312 respectively. The active pressure valve control circuit 48 computes an error function which if not zero is used by the ECM to generate a control signal 40 that is communicated to the pressure control valve 34 as shown at block 314. If the error function is zero then no further adjustment of the pressure control valve is needed and the control loop returns to query the pressure sensor 30.

The dynamic response of the pressure control valve and the pressure sensor will impact the ability of the system 10 to actively control the fuel pressure in the fuel rail pressure. In other words, the rate at which the pressure control valve can open and close and the sampling rate of the pressure sensor will determine the system's ability to attenuate pressure fluctuations in the fuel rail assembly 20 through the operating range of the engine. However, computer-modeling has demonstrated that attenuation of the fuel pressure pulses can be achieved with pressure control valves having a time constant less than 0.05 seconds and that significant attenuation can be achieved with pressure control valves have a time constant in the range of 0.01-0.001 seconds.

As described above, a PI closed-loop feedback control algorithm is used in the fuel injection system 10. This algorithm has been shown to provide a simple and effective means for providing active pressure control. One skilled in the art should recognize that other feedback control algorithms may be used for wideband fuel rail control using active pressure control valves. Such algorithms may include higher order control and/or may be executed in combination with the control of other components within the fuel injection system such as the metering unit, the high-pressure injector pump or the injector pulse profile.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fuel injection apparatus for an internal combustion engine having a plurality of combustion chambers, the apparatus comprising:

a fuel injection system including a fuel injector pump for supplying a fuel to a fuel rail assembly and a plurality of fuel injectors fluidly coupled to the fuel rail assembly, each of the plurality of fuel injectors operable for injecting the fuel into an associated one of the plurality of combustion chambers;

a fuel pressure control valve fluidly coupled to the fuel rail assembly and operable to adjust the fuel pressure in the fuel rail assembly in response to a valve control signal;

a pressure sensor fluidly coupled to the fuel rail assembly and operable to generate a fuel pressure signal indicating a measured fuel pressure in the fuel rail assembly;

a fuel pressure control module having a first input receiving the fuel pressure signal, a second input receiving a reference fuel pressure, and an active pressure control circuit generating the valve control signal as a function of the difference between the fuel pressure signal and the reference fuel pressure;

wherein active pressure control circuit controls the fuel pressure control valve so as to attenuate fuel pressure fluctuations in the fuel rail system over the entire range of engine operating conditions of the internal combustion engine.

2. The fuel injection apparatus of claim 1 wherein the fuel pressure control valve opens when the measured fuel pressure is greater than the reference fuel pressure, and wherein the fuel pressure control valve closes when the measured fuel pressure is less than the fuel reference pressure.

3. The fuel injection apparatus of claim 2 wherein the active pressure control circuit comprises a proportional-integral feedback control of the error between the measured fuel pressure and the reference fuel pressure.

4. The fuel injection apparatus of claim 1 wherein active pressure control circuit comprises frequency domain control for attenuating pressure fluctuations in the fuel rail system.

5. A method for attenuating pressure wave fluctuations in a fuel rail assembly of a fuel injection system comprising:

supplying a fuel from a fuel source to a fuel rail assembly at a pump pressure;

injecting the fuel from the fuel rail assembly through a plurality of injectors;

measuring a fuel pressure in the fuel rail assembly;

computing a valve control signal in an active pressure control circuit as a function of the difference between the measured fuel pressure to a reference fuel pressure; and actively controlling a pressure control valve in response to the valve control signal so as to attenuate fuel pressure fluctuations in the fuel rail assembly over the entire range of engine operating conditions of the internal combustion engine.

6. The method of claim 5 wherein actively controlling the pressure control valve comprises opening the pressure control valve when the measured fuel pressure is greater than the reference fuel pressure; and closing the pressure control valve when the measured fuel pressure is less than the fuel reference pressure.

7. The method of claim 6 wherein the valve control signal is computed using a proportional-integral feedback control algorithm to determine an error between the measured fuel pressure and the reference fuel pressure.

8. The method of claim 5 wherein actively controlling the pressure control valve comprises controlling the pressure control valve in the frequency domain.

* * * * *